US009399253B2

(12) United States Patent
Yamanaka et al.

(10) Patent No.: US 9,399,253 B2
(45) Date of Patent: Jul. 26, 2016

(54) METHOD FOR CONTINUOUSLY CASTING SLAB FOR HEAVY GAUGE STEEL PLATE

(71) Applicant: NIPPON STEEL & SUMITOMO METAL CORPORATION, Tokyo (JP)

(72) Inventors: Akihiro Yamanaka, Tokyo (JP); Kenji Taguchi, Kashima (JP); Naoki Tajima, Kashima (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/892,247

(22) PCT Filed: Jun. 17, 2014

(86) PCT No.: PCT/JP2014/066050

§ 371 (c)(1),
(2) Date: Nov. 19, 2015

(87) PCT Pub. No.: WO2014/203902

PCT Pub. Date: Dec. 24, 2014

(65) Prior Publication Data

US 2016/0089714 A1 Mar. 31, 2016

(30) Foreign Application Priority Data

Jun. 18, 2013 (JP) ..... 2013-127208

(51) Int. Cl.
*B22D 11/128* (2006.01)
*B22D 11/00* (2006.01)
*B22D 11/20* (2006.01)

(52) U.S. Cl.
CPC ..... *B22D 11/00* (2013.01); *B22D 11/128* (2013.01); *B22D 11/1287* (2013.01); *B22D 11/20* (2013.01)

(58) Field of Classification Search
CPC ..... B22D 11/128; B22D 11/1282; B22D 11/142; B22D 11/20; B22D 11/208; B21B 1/46
USPC ..... 164/441, 442, 448, 476, 484
See application file for complete search history.

(56) References Cited

U.S. PATENT DOCUMENTS 5,853,043 A * 12/1998 Takeuchi ..... B22D 11/1206 164/417
7,086,450 B2 * 8/2006 Hiraki ..... B22D 11/1206 164/417
8,162,032 B2 * 4/2012 Arvedi ..... B21B 1/463 164/417

FOREIGN PATENT DOCUMENTS

JP 2007-196265 8/2007
JP 2009-255173 11/2009
JP 2010-227941 10/2010

OTHER PUBLICATIONS

EPO machine translation of JP 2010-227941, Oct. 14, 2010.*

*Primary Examiner* — Kevin E Yoon
(74) *Attorney, Agent, or Firm* — Clark & Brody

(57) ABSTRACT

A primary object of the present invention is to provide a method for continuous casting with which slabs for heavy gauge steel plate in which porosities are decreased can be manufactured. In the present invention, when a slab for heavy gauge steel plate is continuously cast, two pairs of reduction rolls that are arranged separately from each other with a roll-interval in a range from 3 m to 7 m, between which a support roll is arranged, are used, reduction is carried out on the slab by 3 to 15 mm with the reduction rolls at the first stage under the condition where the slab includes an unsolidified portion with the solid-phase ratio in a range from 0.8 to less than 1, and reduction is further carried out on the slab with the reduction rolls at the second stage under the condition where the slab is completely solidified.

4 Claims, 1 Drawing Sheet

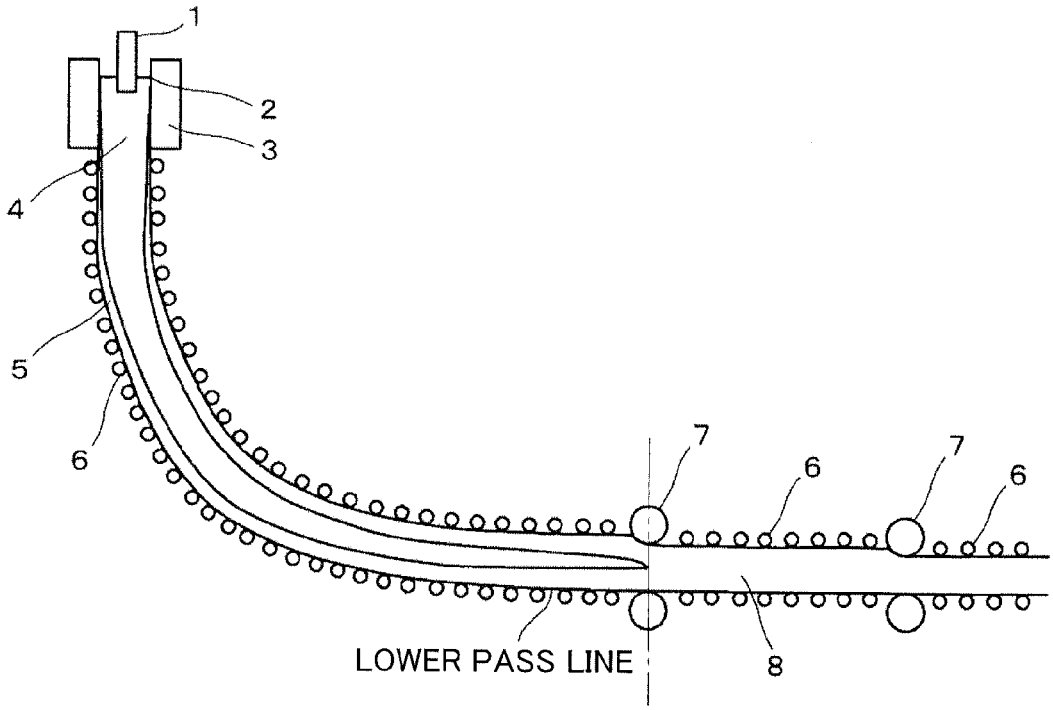
1
2
3
4
5
6
7
6
7
6
LOWER PASS LINE
8

METHOD FOR CONTINUOUSLY CASTING SLAB FOR HEAVY GAUGE STEEL PLATE

TECHNICAL FIELD

This invention relates to a method for continuously casting slabs that are used as a material for manufacturing heavy gauge steel plate that is used for bridges, building components and so on.

BACKGROUND ART

In a case where continuously cast slabs are rolled as a material in manufacturing heavy gauge steel plate, a high reduction ratio (thickness of a slab after casting/finish thickness of rolled steel plate) cannot be given. Thus, there is a problem that small holes that are casting defects (hereinafter referred to as "porosities") remain about the centers of slabs in the thickness direction without being pressed enough to be collapsed, which causes product defects. In a case where continuous casting of slabs having large cross-sections is assumed for a high reduction ratio, low-speed casting is necessary because of the limit of machine length, which is very inefficient. Although such a method is also considered that ingots of large diameters are cast with common ingot casting but not continuous casting, the efficiency gets much worse than continuous casting.

The inventors of the present invention propose in Patent Literature 1 the following method for manufacturing heavy gauge steel plate in order to solve the above problem: under the condition that the reduction ratio r until finish rolling is 1.5 to 4.0, hot-rolling, as a material, a slab that is cast by reduction on the central part of the slab in the width direction by 3 to 15 mm with a pair of reduction rolls under the condition where the slab includes an unsolidified part while the solid-phase ratio of the central part of the slab in the thickness direction is no less than 0.8 and less than 1.0, to reduce the central porosity volume. Application of this method makes porosities in heavy gauge steel plate be considerably reduced by ¼ to ⅓ of the level of the porosities when an original slab, which is cast without reduction, is used as a material.

Even if the above-mentioned method of Patent Literature 1 is applied, there still remain considerable porosities in slabs for heavy gauge steel plate. Therefore, it must be said that the above-mentioned method of Patent Literature 1 is not sufficient for measures for the decrease of porosities in view of the request for the decrease of porosities, which is predicted to be more and more severe for the future, the tendency to consider it desirable that thinner slabs are cast at high speed and the reduction ratio in rolling is kept down, to finish steel plate, and so on.

Patent Literatures 2 and 3 describe continuous casting equipment for steel where plural pairs of rolls each of which is integrally formed in the axial direction with a large roll diameter of over 400 mm are arranged. While it is considered that reduction on slabs with plural pairs of rolls like this is extremely effective for decreasing porosities, the occurrence of the following problem is expected.

Arrangement of plural pairs of rolls with such large diameters causes bulging between rolls to occur several times when slabs whose central parts are unsolidified pass through the rolls. This brings about worse segregation of components such as carbon, sulfur and phosphorus in the central parts of the slabs (centerline segregation), occurrence of cracks on solidification interfaces (internal cracking), and so on. Even if completely solidified slabs pass through the rolls with large diameters, and reduction is tried to be carried out thereon with multistage rolls with large diameters in order to press to collapse porosities that occur in solidifying, there is a problem that reduction between the continuous rolls makes work hardening progress and the reduction does not progress so much.

CITATION LIST

Patent Literature

Patent Literature 1: JP2007-196265A
Patent Literature 2: JP2009-255173A
Patent Literature 3: JP2010-227941A

SUMMARY OF INVENTION

Technical Problem

As described above, in a case where heavy gauge steel plate is manufactured with continuously cast slabs as a material, a high reduction ratio cannot be given, and thus there is a problem that porosities remain about the centers of the slabs in the thickness direction, which causes product defects.

The present invention is made in view of the above problem. An object of the present invention is to provide a method for continuously casting a slab for heavy gauge steel plate with which a slab that is used as a material for manufacturing heavy gauge steel plate and in which porosities remaining about its center in the thickness direction are extremely decreased can be manufactured without bringing about worse centerline segregation or internal cracking, and without work hardening preventing reduction.

Solution to Problem

The inventors of the present invention have repeatedly carried out heat transfer analyses and various tests in order to solve the above problem. As a result, they found out that the following method is effective for decreasing porosities, and moreover, problems of occurrence of other defects such as worse centerline segregation and internal cracking do not arise:

(a) two pairs of reduction rolls are used for reduction on a slab. It is desirable that the diameter of each roll is 450 mm or more;

(b) two pairs of the reduction rolls are arranged with an interval between the pairs in the range from 3 m to 7 m (separate arrangement), and support rolls with a normal roll-interval (330 mm or less) are arranged between the pairs of the reduction rolls. The interval between one pair of the reduction rolls and support rolls adjacent to the pair may be beyond 330 mm, but is shortened as much as possible.

(c) reduction is carried out on the slab with the first reduction rolls (at the first stage) under the condition where the slab includes an unsolidified portion in the range of the solid-phase ratio of its central part from 0.8 to less than 1 until the reaction that acts on the rolls (hereinafter also referred to as "reduction reaction") becomes the largest.

(d) further, reduction is carried out on the slab with the reduction rolls at the second stage under the condition where the slab is completely solidified until the reduction reaction becomes the largest.

The present invention is made based on the above finding, and its summary lies in the following method for continuous casting.

That is, a method for continuously casting a slab that is used as a material for manufacturing heavy gauge steel plate by hot-rolling includes using two pairs of reduction rolls, the pairs being arranged separately from each other with an interval between the pairs in a range from 3 m to 7 m, between the pairs a support roll being arranged, carrying out reduction on a slab by 3 to 15 mm with one pair of the reduction rolls located at a first stage under a condition where the slab includes an unsolidified portion with a solid-phase ratio of a central part of the slab in a thickness direction in a range from 0.8 to less than 1 and, further carrying out reduction on the slab with another pair of the reduction rolls located at a second stage under a condition where the slab is completely solidified.

In the method for continuously casting a slab for heavy gauge steel plate of the present invention, a diameter of each of the pairs of the reduction rolls is 450 mm or more. Whereby the reduction efficiency at the central part of a slab where porosities exist can be improved. Thus, it is desirable.

It is preferable that in the method for continuously casting a slab for heavy gauge steel plate of the present invention, a plurality of the support rolls are arranged between two pairs of the reduction rolls, and an interval between the support rolls, which are adjacent to each other, is 330 mm or less. Whereby, bulging between rolls is easy to be inhibited, and thus, it gets easy to inhibit occurrence of internal cracking and worse centerline segregation.

"Heavy gauge steel plate" in the present invention means steel plate that is obtained by rolling a slab cast by the method for continuous casting, and that is 80 mm or more in thickness.

Advantageous Effects of Invention

According to the method for continuous casting of the present invention, a slab that is used as a material for manufacturing heavy gauge steel plate by hot-rolling and in which porosities remaining about its center in the thickness direction are extremely decreased can be manufactured without bringing about worse centerline segregation, internal cracking, or the like.

BRIEF DESCRIPTION OF DRAWINGS

FIG. 1 schematically depicts a structure of a vertical bending-type continuous casting machine that is used for a continuous casting test.

DESCRIPTION OF EMBODIMENTS

As described above, the present invention is a method for continuously casting a slab that is used as a material for manufacturing heavy gauge steel plate by hot-rolling including using two pairs of reduction rolls, the pairs being arranged separately from each other with an interval between the pairs in a range from 3 m to 7 m, between the pairs a support roll being arranged, carrying out reduction on a slab by 3 to 15 mm with one pair of the reduction rolls located at a first stage under a condition where the slab includes an unsolidified portion with a solid-phase ratio of a central part of the slab in a thickness direction in a range from 0.8 to less than 1 and, further carrying out reduction on the slab with another pair of the reduction rolls located at a second stage under a condition where the slab is completely solidified.

The method for continuous casting of the present invention will be described with reference to the drawing below.

FIG. 1 schematically depicts a structure of a vertical bending-type continuous casting machine that is used for a continuous casting test. Molten steel 4 pouring from a tundish (not depicted) via a submerged nozzle 1 into a mold 3 is cooled by water spray jetting out from the mold 3 and a group of secondary cooling spray nozzles that is under the mold 3 (not depicted), and a solidified shell 5 is formed to be a slab 8. The slab 8 passes through a group of support rolls 6 as keeping unsolidified portions in its inside, and is withdrawn by pinch rolls (not depicted).

The reason why continuous casting is not applied to slabs that are used as a material for manufacturing heavy gauge steel plate is that as described above, in a case where heavy gauge steel plate is manufactured by hot-rolling a continuously cast slabs, a high reduction ratio cannot be given; and thus there is a problem that porosities existing about the centers of the slabs in the thickness direction remain even after the hot-rolling, which causes product defects. In order to solve the problem, manufactured in the present invention is a slab for heavy gauge steel plate in which porosities in the slab is extremely decreased so that porosities do not remain in steel plate after the hot-rolling.

In the present invention, two pairs of reduction rolls that are arranged separately from each other (that is, arranged with a predetermined interval) are used in order to obtain a slab where porosities are extremely decreased as described below.

The first reason why two pairs of the reduction rolls are used which are arranged separately from each other with a roll-interval in the range of 3 m to 7 m is to inhibit the occurrence of bulging between the rolls.

The roll-interval is predetermined even with a some allowable range, generally. Thus, if the interval of the reduction rolls is less than 3 m, there occur plural long roll-intervals between reduction rolls and support rolls or between support rolls in the longitudinal direction of casting. If the interval of the reduction rolls is further shortened, there is no space for arranging support rolls between two pairs of the reduction rolls, and as a result, the reduction rolls themselves are arranged continuously, which causes the occurrence of plural long roll-intervals as well. It is known that in a case where the roll-interval is long, bulging between the rolls increase by power of the roll-interval. Existence of a plurality of such intervals within a short range in the casting direction causes the risk of the occurrence of internal cracking to increase, and also causes worse centerline segregation to be brought about. In the above view, it is preferable that the interval between two pairs of reduction rolls that are arranged separately from each other and support rolls adjacent thereto is no more than 330 mm.

The second reason why two pairs of the reduction rolls are used which are arranged separately from each other is because in a case where the reduction rolls at the first stage and the reduction rolls at the second stage are arranged within a short section, reduction at the second stage does not progress so much due to work hardening on the surface of a slab, which is caused by reduction at the first stage. The inventors of the present invention have found out that arrangement of two pairs of the reduction rolls with an interval of at least 3 m makes relaxation of stress progress between the reduction at the first stage and the reduction at the second stage, and a more reduction can be secured in the reduction at the second stage than a case where the interval between the reduction rolls is short. It is considered that because the slab is still at a high temperature, such relaxation of stress can progress.

It is because the slab passing through two pairs of the reduction rolls is supported that support rolls are arranged between two pairs of the reduction rolls. It is preferable that the interval between support rolls adjacent to each other that are arranged between two pairs of the reduction rolls is no more than 330 mm in view of easy inhibition of the occurrence of internal cracking or worse centerline segregation by easy inhibition of bulging between rolls. Although the lower limit of the interval between the support rolls is not especially specified, it is desirable that the interval is longer than at least the diameter of a support roll plus 30 mm in view of installation of spray piping for secondary cooling between the support rolls.

The maximum of the interval between the reduction rolls at the first stage and the reduction rolls at the second stage is 7 m because if the interval of two pairs of the reduction rolls is more than 7 m, the temperature of the slab largely decreases, deformation resistance of the slab gets great, and the reduction by the reduction rolls at the second stage does not progress so much. In addition, it is surmised that the temperature difference between the center and the surface of the slab gets small, and the reduction efficiency at the center of the slab declines.

In the present invention, two pairs of the reduction rolls described above are used. With the reduction rolls at the first stage, reduction is carried out on the slab by 3 to 15 mm under the condition where the slab includes an unsolidified portion with the solid-phase ratio of the central part of the slab in the thickness direction in the range of 0.8 and less than 1. Moreover, with the reduction rolls at the second stage, reduction is carried out on the slab under the condition where the slab is completely solidified.

With the solid-phase ratio of the central part of the slab in the thickness direction in the range of 0.8 and less than 1, unsolidified molten steel even slightly remains at the central part. The temperature at the central part is still very high and deformation resistance is low, and large efficient reduction at the central part can be efficiently achieved. At these temperatures (temperatures where the solid-phase ratio is 0.8 or more, and less than 1), formation of porosities is being almost completed. Thus, it is quite effective for decreasing porosities that reduction is carried out on the slab with the reduction rolls at the first stage under the condition where the slab includes an unsolidified portion.

A reduction necessary for decreasing porosities is at least 3 mm. The more a reduction is, the more effectively porosities are decreased. However, in this time (that is, when the solid-phase ratio is 0.8 or more, and less than 1), a reduction taken by rolls at one stage is about 15 mm at the maximum. In order to secure a reduction of more than 15 mm, excessive structural apparatuses are required and the diameter of a reduction roll becomes long. As a result, the problems described above are likely to arise such as occurrence of bulging, worse centerline segregation and occurrence of internal cracking accompanied by the bulging, and so on.

Next, reduction is carried out on the slab with the reduction rolls at the second stage under the conditions where the slab is completely solidified. While the reduction rolls at the second stage are at a distance away from those at the first stage, which makes cooling of the slab progress, deformation resistance of the slab is not very large if the distance is 3 m or more and 7 m or less (time interval required for passing through the distance) as described above. Although a reduction with the reduction rolls at the second stage is smaller than that with the reduction rolls at the first stage, it is found out that if the reduction rolls at the second stage are the same roll diameters and reduction performance as those of the reduction rolls at the first stage, about 50 to 70% of a reduction of the reduction rolls at the first stage can be obtained from those at the second stage.

The larger the ratio of inside and outside deformation resistance of the central part and the surface of the slab (deformation resistance of the surface/deformation resistance at the central part) is, the more the reduction efficiency at the central part increases. It is found out by analyses that while the ratio of inside and outside deformation resistance of the slab in the reduction at the first stage is 5 to 7 when proper cooling adjustment is carried out on the slab, that in the reduction at the second stage is still about 4 to 5, which means not so large difference arises. This is because while the reduction moves from the first stage to the second stage, the temperature at the central part of the slab does no decrease so much.

That is, it is estimated by solidification heat transfer analyses that if the temperature at the central part of the slab in the reduction at the first stage is "solidus temperature plus 50° C.", that in the reduction at the second stage drops from the temperature at the first stage by about 100 to 150° C., and the central part of the slab still keeps an enough high temperature compared with the temperature at the surface of the slab.

With reference to test results in Examples described below, the reduction at the first stage decreases the volume of porosities by 30 to 40% of that when reduction is not carried out. The reduction at the second stage decreases the volume of porosities by 40 to 60% of that before the reduction at the second stage. Continuous reduction at the first stage and the second stage brings the volume of porosities to be 12 to 24% compared with the case where reduction is not carried out. A remarkable effect of decreasing porosities is obtained.

In the present invention, the diameter of two pairs of the reduction rolls is 450 mm or more, which makes it possible to improve the reduction efficiency at the central part of the slab where porosities exist. Thus, it is desirable.

The reason why the desirable diameter of a reduction roll is 450 mm or more is to inhibit roll deformation and to improve the reduction efficiency at the central part of the slab where porosities exist. If the deformation strength (deformation resistance) of the slab is high and the roll diameter is shorter than 450 mm when the slab is reduced at the last of solidification in order to decrease porosities, reduction rolls themselves are easy to deform. In addition, if the roll diameter is short, deformation due to reduction is absorbed in the vicinity of the surface of the slab, and the reduction efficiency at the inside becomes low.

The upper limit of the diameter of a reduction roll is not especially specified. However, 600 mm is desirable. If the roll diameter is longer than 600 mm, reduction reaction increases, and frame structures and so on for supporting rolls become bigger. Thus, there occurs a case where rolls cannot be installed into a continuous casting machine, which is not practical.

EXAMPLES

For confirming the effects of the present invention, a slab of 0.6% carbon steel of 300 mm in thickness and 1800 mm in width was continuously cast, and porosity check was carried out on the obtained slab.

A continuous casting machine used here was a vertical bending-type continuous casting machine having the structure schematically depicted in FIG. 1. Each of the reduction rolls 7 at the first stage and the second stage was 470 mm in diameter, and a squeezing force thereof was $5.88\times10^3$ kN (600 ton) at the maximum. The diameter of each support roll 6 around the reduction rolls 7 was 210 mm.

The reduction rolls 7 at the first stage were arranged 21 m downstream from a molten steel meniscus 2 in the mold 3. The reduction rolls 7 at the second stage were arranged 24 m downstream (case I) or 27 m downstream (case II) from the meniscus 2. The interval between the reduction rolls 7 and the support rolls 6 that were just before the rolls 7 was 380 mm.

The interval between the reduction rolls 7 and the support rolls 6 that were just after the rolls 7 was 255 mm. The interval between the support rolls 6 was 245 mm.

The molten steel 4 pouring via the submerged nozzle 1 into the mold 3 was cooled by water spray jetting out from the mold 3 and a group of secondary cooling spray nozzles that was under the mold 3 (not depicted), and the solidified shell 5 was formed to be the slab 8. The volume of secondary cooling water was 0.85 L (liters)/Kg-Steel. The slab passed through a group of support rolls as keeping unsolidified portions in its inside, and was withdrawn by pinch rolls (not depicted).

Table 1 represents test conditions and test results of continuous casting of the slab.

TABLE 1

| No. | Vc (m/min) | Solid-phase Ratio at Center of Thickness just before Reduction at First Stage (—) | Reduction (mm) First Stage | Reduction (mm) Second Stage | $V/V_0$ (%) |
|---|---|---|---|---|---|
| Example I-1 | 0.58 | 0.81 | 12 | 8.5 | 12.4 |
| Example I-2 | 0.57 | 0.86 | 10 | 6.3 | 19.5 |
| Example I-3 | 0.55 | 0.95 | 8 | 4.8 | 22 |
| Example II-1 | 0.58 | 0.81 | 12 | 7.3 | 15.6 |
| Example II-2 | 0.57 | 0.86 | 10 | 5.2 | 21.2 |
| Example II-3 | 0.55 | 0.95 | 8 | 4.1 | 23.8 |
| Comparative Example 1 | 0.58 | 0.81 | 12 | 0 | 30.4 |
| Comparative Example 2 | 0.57 | 0.86 | 10 | 0 | 35.8 |
| Comparative Example 3 | 0.55 | 0.95 | 8 | 0 | 38.9 |
| Comparative Example 4 | 0.58 | — | 0 | 0 | 100 |
| Comparative Example 5 | 0.57 | — | 0 | 0 | 100 |
| Comparative Example 6 | 0.55 | — | 0 | 0 | 100 |

The solid-phase ratios (fs) at the center of the slab in the thickness direction just before reduction were determined by calculating temperature distribution in the direction of thickness by means of unsteady heat transfer analysis.

Porosity check on the obtained slab was carried out by obtaining change in the volume of porosities per unit mass in both cases where reduction was carried out and reduction was not carried out.

Specifically, 15 points were defined equally in the direction of width on a block of a cross-section of a constant portion of the slab obtained by continuous casting, and samples were taken from the central part of each point in the direction of thickness. The densities of the samples were measured to obtain the average, to be defined as the density at the center in the thickness direction (ρv). The size of each sample was such that a surface parallel to the cross section of the slab was 30 mm×30 mm and the thickness was 20 mm. Similarly, samples were taken from the center of the slab in the direction of width at ¼ in the thickness direction, and its density was measured. There was usually almost no porosity at the position of ¼ in the thickness direction. Thus, this density was defined as a reference density (ρ).

The densities were calculated from their masses and volumes. The volumes were calculated from the density of water and buoyancy that was obtained by immersing the samples in water and measuring their masses in water.

The volume of porosities per unit mass (V), which was defined by the following (1) formula, was calculated from the reference density (ρ) at the position of ¼ in the thickness direction and the density at the center in the thickness direction (ρv).

$$V=1/\rho v-1/\rho \quad (1)$$

As well as the above, samples of a slab, which was continuously cast without reduction processing, was also taken and the volume of porosities per unit mass was calculated. This was defined as the reference volume of porosities ($V_0$).

"$V/V_0$(%)" represented in Table 1 represents change in the volume of porosities as the ratio (percentage) of the volume of porosities when reduction was carried out (V) to the volume of porosities when continuous casting was carried out without reduction ($V_o$) under a condition of the same casting velocity (Vc).

In Table 1, Case I of Examples (Cases I-1 to I-3 according to the casting velocity) was a case where the reduction rolls at the second stage were arranged 24 m downstream from the meniscus, and Case II (Cases II-1 to 11-3) was a case where the reduction rolls at the second stage were arranged 27 m downstream from the meniscus. Comparative Examples were a case where reduction was carried out only with the reduction rolls at the first stage (Comparative Examples 1 to 3) and a case where no reduction was carried out (Comparative Examples 4 to 6).

The casting velocity (Vc) was selected according to the location of the rolling-reduction at the first stage from the meniscus. In a case of these Examples, the casting velocity was changed within the range of 0.55 to 0.58 m/min at the reduction rolls at the first stage, which was arranged 21 m downstream from the meniscus, as represented in Table 1.

Every charge on which reduction was carried out was pressed with reduction rolls until the reduction reaction became $5.88\times10^3$ kN (600 ton), which was the maximum.

As represented in Table 1, in a case where the rolling-reduction was carried out at the first stage and the second stage (Examples I-1 to I-3 and Examples II-1 to II-3), while a reduction at the second stage was less than that at the first stage in every condition, the final volumes of porosities extremely effectively decreased to 12.4 to 23.8% of the original volume of porosities (of Comparative Examples 4 to 6 as a reference). On the other hand, in a case where only the rolling-reduction at the first stage was carried out (Comparative Examples 1 to 3), the volumes of porosities were 30.4 to 38.9% of the reference volume of porosities. The decrease of porosities did not progress so much compared with the case where the rolling-reduction was carried out at the first stage and the second stage.

Concerning centerline segregation of the obtained slabs, the level of the conventional continuous casting, in which reduction was not processed (Comparative Examples 4 to 6), was kept in every Example I-1 to 1-3, Example II-1 to 11-3 and Comparative Example 1 to 3, and the occurrence of internal cracking was not confirmed as well. This was because the influence of bulging between rolls was able to be inhibited so as to be same as that of conventional bulging by the arrangement of both reduction rolls and support rolls appropriately as described above.

Although it is not represented, in a case where the interval of two pairs of the reduction rolls was less than 3 m, the reduction at the second stage did not progress so much, and $V/V_0$(%) did not have much difference from $V/V_0$(%) in Comparative Examples 1 to 3, in which only the rolling-reduction at the first stage was carried out. It was surmised that this was because of work hardening on the surface of the slab due to the rolling-reduction at the first stage.

In a case where the interval of two pairs of the reduction rolls was over 7 m, reduction also did not progress so much, and $V/V_0$(%) did not have much difference from $V/V_0$(%) in Comparative Examples 1 to 3, in which only the rolling-reduction at the first stage was carried out. It was surmised that in this case, this was because of the increase of deformation resistance due to the decrease of the temperature of the slab, and worse reduction efficiency at the central part of the slab due to a small difference in temperature between the center and the surface of the slab.

From the above test results, the effect of the method for continuous casting of the present invention was confirmed that a slab was reduced with two pairs of reduction rolls arranged under predetermined conditions.

INDUSTRIAL APPLICABILITY

According to the method for continuous casting of the present invention, a slab for heavy gauge steel plate in which porosities remaining about its center in the thickness direction are extremely decreased can be manufactured without bringing about worse centerline segregation or internal cracking. Therefore, the present invention can be effectively utilized for manufacturing slabs that are used as a material for manufacturing heavy gauge steel plate that is used for bridges, building components and so on.

REFERENCE SINGS LIST

1: submerged nozzle, 2: molten steel meniscus; 3: copper mold, 4: molten steel, 5: solidified shell, 6: support roll, 7: reduction roll, 8: slab

The invention claimed is:

1. A method for continuously casting a slab that is used as a material for manufacturing heavy gauge steel plate by hot-rolling, the method comprising:

using two pairs of reduction rolls, the pairs being arranged separately from each other with an interval between the pairs in a range from 3 m to 7 m, between the pairs a support roll being arranged;

carrying out reduction on a slab by 3 to 15 mm with one pair of the reduction rolls located at a first stage under a condition where the slab includes an unsolidified portion with a solid-phase ratio of a central part of the slab in a thickness direction in a range from 0.8 to less than 1; and, further carrying out reduction on the slab with another pair of the reduction rolls located at a second stage under a condition where the slab is completely solidified.

2. The method for continuously casting a slab for heavy gauge steel plate according to claim 1, wherein a diameter of each of the pairs of the reduction rolls is 450 mm or more.

3. The method for continuously casting a slab for heavy gauge steel plate according to claim 1 or 2, wherein a plurality of the support rolls are arranged between two pairs of the reduction rolls, and an interval between the support rolls, which are adjacent to each other, is 330 mm or less.

4. The method for continuously casting a slab for heavy gauge steel plate according to claim 2, wherein a plurality of the support rolls are arranged between two pairs of the reduction rolls, and an interval between the support rolls, which are adjacent to each other, is 330 mm or less.

* * * * *